US011236753B1

(12) United States Patent
Campbell

(10) Patent No.: US 11,236,753 B1
(45) Date of Patent: Feb. 1, 2022

(54) INDIRECT UPLIGHTING FOR CEILING FANS

(71) Applicant: Lara Anne Campbell, Lone Tree, CO (US)

(72) Inventor: Lara Anne Campbell, Lone Tree, CO (US)

( * ) Notice: Subject to any disclaimer, the term of this patent is extended or adjusted under 35 U.S.C. 154(b) by 20 days.

(21) Appl. No.: 16/873,188

(22) Filed: Feb. 24, 2020

(51) Int. Cl.
*F04D 25/08* (2006.01)
*F21V 33/00* (2006.01)
*F04D 29/00* (2006.01)
*F21Y 115/10* (2016.01)

(52) U.S. Cl.
CPC ..... *F04D 25/088* (2013.01); *F04D 29/005* (2013.01); *F21V 33/0096* (2013.01); *F21Y 2115/10* (2016.08)

(58) Field of Classification Search
CPC .. F04D 25/088; F04D 29/005; F21V 33/0096; F21V 29/67; F21Y 2115/10; F21S 8/02–04
See application file for complete search history.

(56) References Cited

U.S. PATENT DOCUMENTS 4,064,427 A 12/1977 Hansen
4,382,400 A 5/1983 Stutzman
4,626,970 A 12/1986 Huang
D312,688 S 12/1990 Mason
5,079,684 A 1/1992 Lai
5,195,870 A * 3/1993 Liu ..... F04D 25/08 362/96
5,292,228 A 3/1994 Dye
5,440,459 A * 8/1995 Chan ..... F04D 25/088 362/294
5,658,129 A 8/1997 Pearce
D421,115 S 2/2000 Gee
6,019,577 A 2/2000 Dye
6,089,725 A * 7/2000 Chen ..... F04D 25/088 362/149
6,302,556 B1 * 10/2001 Filip ..... F21V 33/0096 362/404
6,309,083 B1 * 10/2001 Lathrop ..... F04D 25/088 362/96
6,450,658 B1 9/2002 Tsuji
6,520,739 B2 * 2/2003 Tsuji ..... F04D 25/088 416/244 R
D511,207 S 11/2005 Young
7,036,949 B2 * 5/2006 Srass ..... F04D 25/088 362/234
D536,439 S 2/2007 Pickett
7,217,082 B2 5/2007 Frampton
7,717,674 B2 5/2010 Tsuji
(Continued)

OTHER PUBLICATIONS

Home Depot webiste Excalibur, Nov. 17, 2014 1 page.
(Continued)

*Primary Examiner* — Joseph L Williams
*Assistant Examiner* — Jose M Diaz
(74) *Attorney, Agent, or Firm* — Henry L. Smith, Jr.

(57) ABSTRACT

Exemplary embodiments of the invention include a housing for light bulbs or light sources, above, and attached to or integrated with, a ceiling fan, thus providing soft non-glaring indirect light upwardly into a room. Light bulbs or light bulb fixtures do not intrude into the space of the room either upwardly or downwardly or horizontally.

14 Claims, 2 Drawing Sheets

(56) References Cited

U.S. PATENT DOCUMENTS

| | | | | |
|---|---|---|---|---|
| 9,441,634 | B2 | 9/2016 | Spiro | |
| 10,208,946 | B2 | 2/2019 | Roca | |
| 2002/0145867 | A1* | 10/2002 | Tsuji | F04D 25/088 362/147 |
| 2005/0207140 | A1* | 9/2005 | Srass | F04D 25/088 362/96 |
| 2009/0122572 | A1* | 5/2009 | Page | F04D 25/088 362/555 |
| 2009/0129974 | A1* | 5/2009 | McEllen | F04D 25/088 422/24 |
| 2011/0286204 | A1 | 11/2011 | Lord | |
| 2015/0110625 | A1* | 4/2015 | De Siqueira Indio Da Costa | F04D 25/088 416/5 |

OTHER PUBLICATIONS

BuyCeilingFan.com 4pages Casablanca Panama Jul. 11, 2016.
Hansen Wholesale 7 pages Jun. 13, 2017.
Kendall Lighging 1 page Jan. 8, 2015.

* cited by examiner

INDIRECT UPLIGHTING FOR CEILING FANS

BACKGROUND AND TECHNICAL FIELD

One useful embodiment or variation of the invention relates to the following field, although the invention may also relate to other fields and uses. The invention may have various embodiments and variations. The general field of the invention is indirect uplighting lighting for ceiling fans.

Most current ceiling fans have lighting features which send harsh light downward, or have bulbs or lighting fixtures which hang down into the room and are unsightly or produce glare in the eyes of people in the room. Other fans have internal bulbs in the housing which are difficult to replace.

BACKGROUND—DESCRIPTION OF RELATED ART

Typical of the art related to widely useful embodiments and variations of the present invention are following patents. The following examples of related art and its limitations are illustrative and not exclusive. Other limitations of the related art will become apparent to those skilled in the art upon study of the specification and drawings of this application. Other embodiments and variations of the invention may relate to other arts and uses. U.S. Pat. No. 4,064,427 Dec. 20, 1997 to Hansen and Pouchert shows bulbs in glass enclosures which cause glare to all persons in the room. U. S. Design Patent Des. 421,115, Feb. 22, 2000 to Gee show light fixtures which hang down in to the room space and cause glare. The present invention avoids these problems.

SUMMARY

One of the widely useful embodiments and variations of the present invention may be summarized as follows. This embodiment or variation is exemplary only. Other embodiments and variations will become apparent to those skilled in the art upon study of the specification and drawings of this application. Other embodiments and variations of the invention may relate to other arts and have usefulness in those arts.

The various embodiments of the invention provide light projected up to the ceiling above a ceiling fan, which light then bounces downwardly providing a soft and diffused light which does not cause glare in the eyes of people in the room, and which does not intrude into the room space which can become (or create) an unattractive situation in a room with lower ceilings. The embodiments of the invention could use ordinary incandescent light bulbs, compact fluorescent bulbs, LED bulbs or many compact light bulbs which could be developed in the future.

PURPOSES AND ADVANTAGES

The invention may have various embodiments and variations and may be useful in different fields and for different purposes. The purposes and advantages of the more widely useful embodiments or variations of the present invention include, but are not limited to, the following, and may include other purposes and advantages in different fields of use not listed herein:

1. The embodiments of the invention produce soft, indirect, not glaring light in a room.
2. The embodiments of the invention do not extend into the room space below the fan in an unattractive and distracting manner, which is a problem in rooms with lower ceilings. Also, the embodiments of the invention do not extend into the room space above the fan in an unattractive and distracting manner.
3. The objective of the indirect uplighted ceiling fan is to provide sufficient uplighting in a room, that does not create glare, and needs no other lighting source.
4. The indirect uplight ceiling fan provides reflected ceiling light without any visible light source from the edge of the fan housing.
5. The indirect uplight ceiling fan housing prevents all light glare as viewed from below.
6. There is no light glare visible, by this design, of the indirect uplight ceiling fan.
7. In higher ceilings this uplight ceiling fan allows a larger reflected ceiling lighting

REFERENCE NUMERALS IN DRAWINGS

1 fan blade
2 fan support pole
3 fan motor housing
4 uplight housing
5 lid of uplight housing and fan enclosure
5*a* transparent/translucent lid
6 light emitting hole
7 uplight diffuser
8 hole for fan support pole
9 light bulb support
10 light bulb
11 wiring
12 fan support pole attachment
13 fan motor rotor

BRIEF DESCRIPTION OF THE DRAWINGS

This Brief Description and the Detailed Description Of The Drawings cover only some embodiments and variations of the invention, and other embodiments and variations will be clear to those skilled in the art from the description, drawings, and Additional Embodiments, etc. The Drawings are illustrative and not limiting.

FIG. 2 shows the lid 5 removed to show internal parts for FIG. 1 including the internal light bulbs and wiring. The uplight housing is integral with the fan motor housing, or could be attached by many conventional means.

In this application, the term "light bulb" includes an incandescent bulb, a compact fluorescent bulb, a bulb containing LEDs, or any other compact electric light source

DETAILED DESCRIPTION OF THE DRAWINGS

Figure 1:
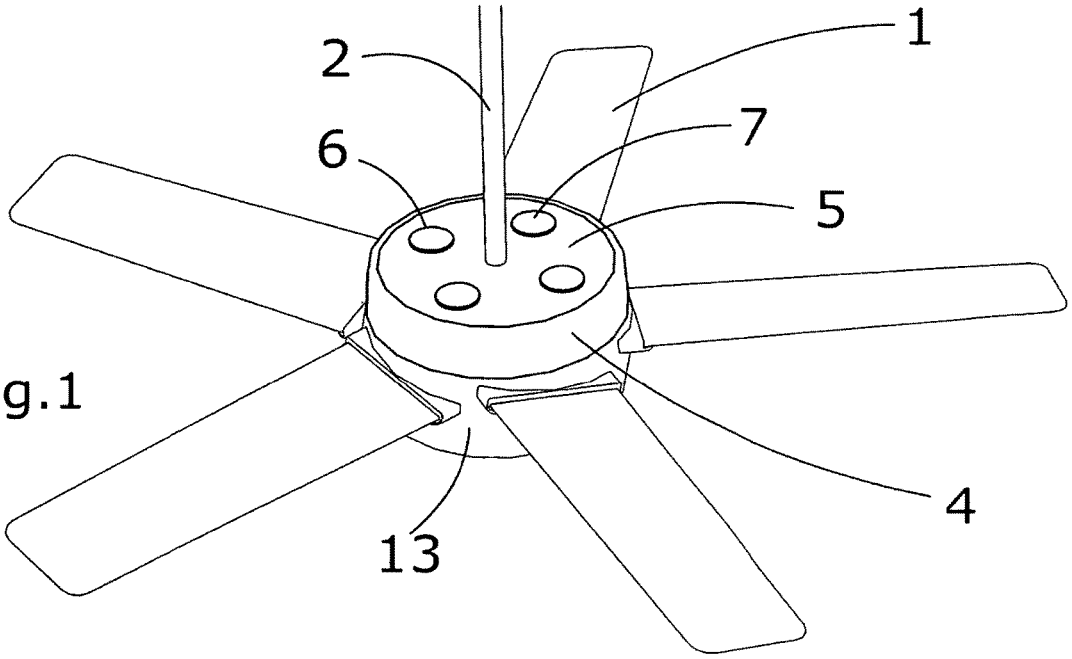
FIGS. 1 and 2 show one embodiment of the invention with uplight housing 4 with light emitting holes 6. The light holes could be in various numbers and shapes.

FIG. 1 shows fan blades 1, fan support pole 2, substantially circular and flat disk-shape uplight housing 4, substantially circular and flat lid of uplight housing and fan enclosure 5, light emitting holes 6, uplight diffusers 7, and fan motor rotor 13. The uplight diffusers could be any transparent or translucent material such as plastic or glass. Parts 4 and 5 could be made of metal, plastic or other conventional materials. In all Figures, the embodiments of the present invention do not include parts 2, 1, 13, 12, 3.

Figure 2:
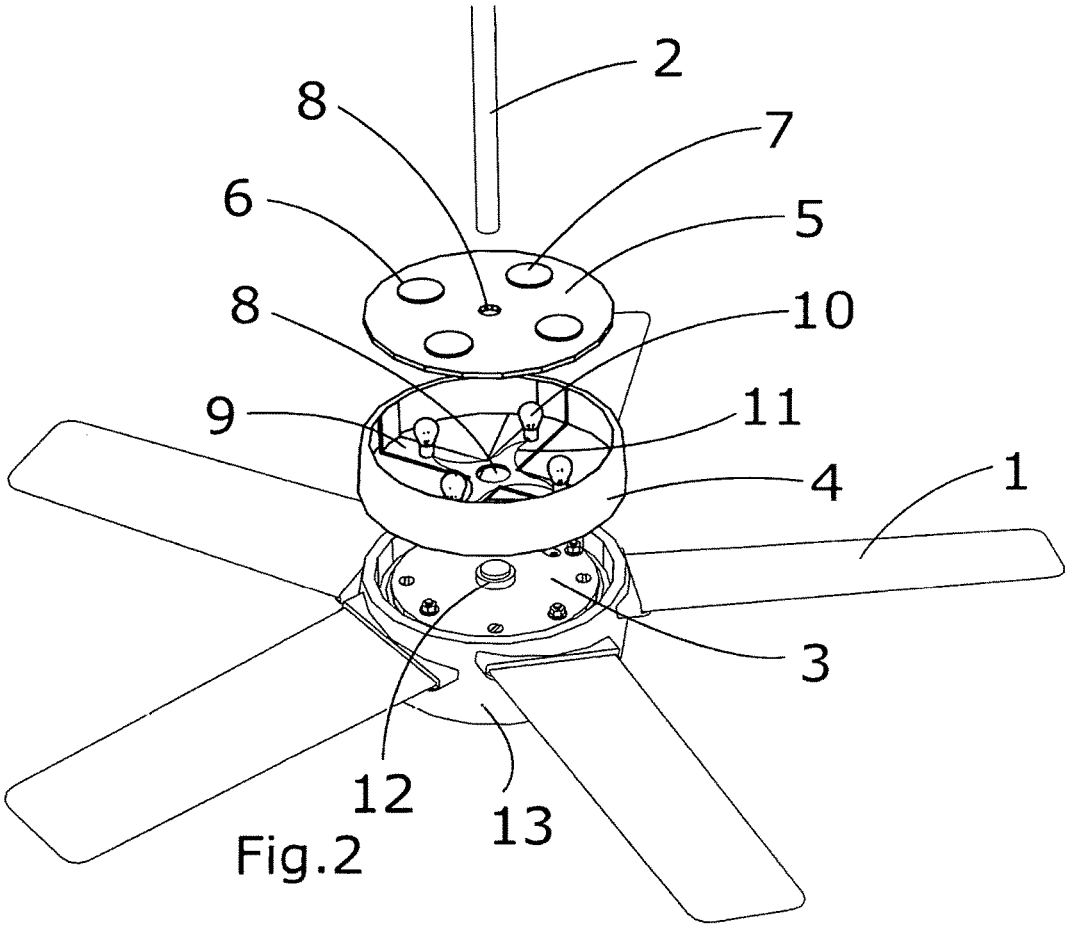

FIG. 2 is essentially the same as FIG. 1, with the lid 5 removed. It shows fan support pole 2, holes 8 for fan support pole. It shows light emitting holes 6, uplight diffusers 7, fan motor rotor 13. It shows fan motor housing 3. It shows internal parts of the uplight housing 4, including light bulb support 9, light bulbs 10, wiring 11. The wiring could be attached to the rest of the fan by conventional methods (not shown) including passing through a hole in the fan motor housing 3 through the fan support pole attachment 12.

Figure 3:
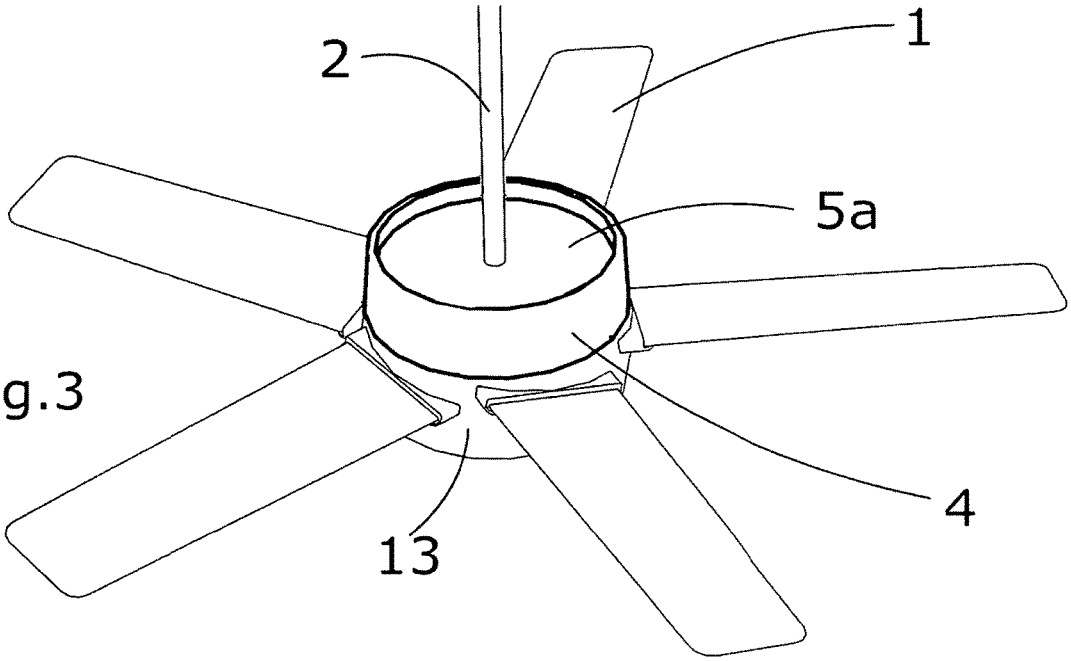
FIG. 3 shows an embodiment with transparent/translucent lid 5*a* through which light from the bulbs can pass upward from the fan assembly.

FIG. 3 is similar to FIG. 1 but with a transparent/translucent lid 5*a* instead of lid 5 with light emitting holes 6 and diffusers 7.

Figure 4:
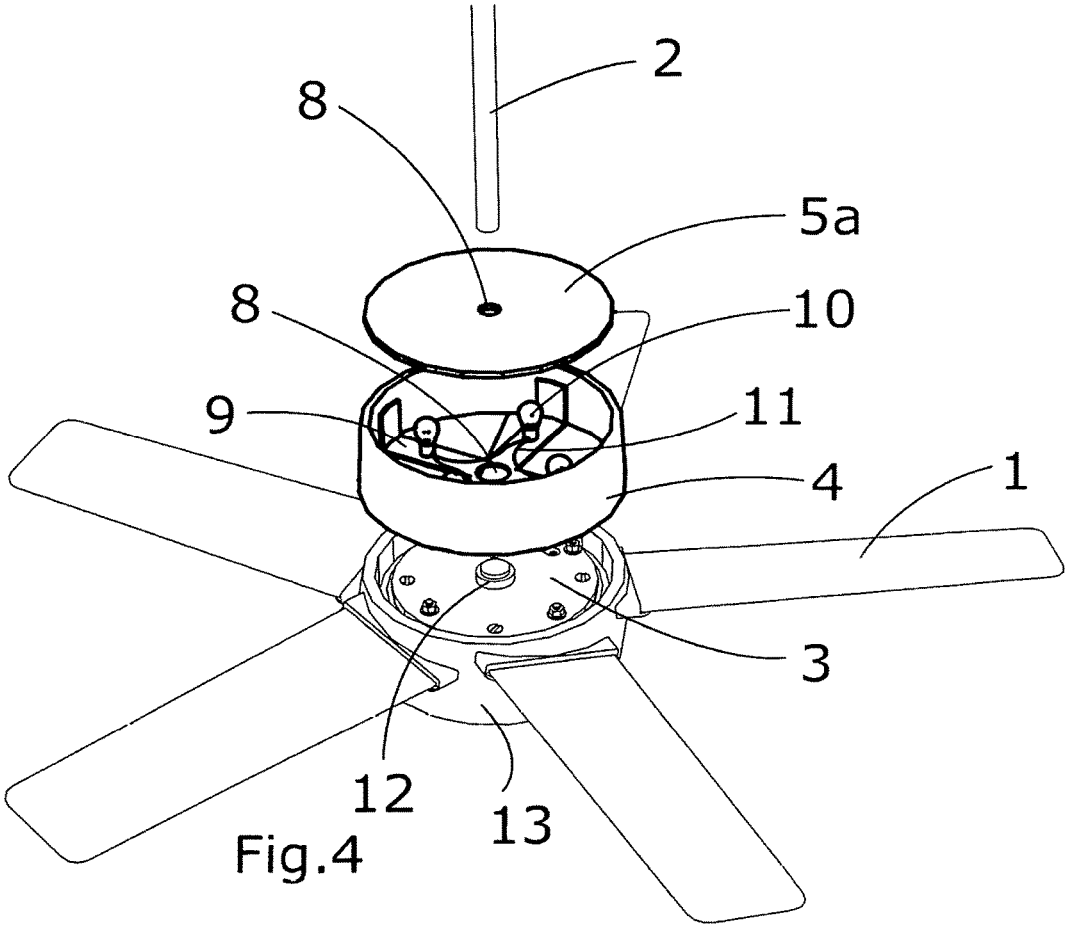
FIG. 4 shows the internal parts of FIG. 3 similarly to FIG. 2.

FIG. 4 is similar to FIG. 2 except there is a translucent/transparent lid 5*a* instead of lid 5 with light emitting holes 6. In FIGS. 3 and 4 light from the bulbs is emitted upwardly through translucent/transparent lid 5*a* instead of through light emitting holes and diffusers 6 and 7. The other parts 1, 8, 2, 9, 10, 11, 3, 12, 13 are the same.

DESCRIPTION-PREFERRED EMBODIMENT

The following embodiment or variation of the invention is the embodiment presently preferred by the Inventor, but over time other embodiments and variations and uses in other areas may become preferred to those skilled in the art. The preferred embodiments include the embodiments in FIGS. 1, 2, 3 and 4.

OPERATION OF ONE EMBODIMENT

The lights could be operated by a separate room wall switch in addition to the fan wall switch, or by a pull chain hanging from the fan (all not shown), all as commonly provided for conventional ceiling fans.

ADDITIONAL EMBODIMENTS

Additional embodiments could include different materials for uplight housing 4, lid 5, diffusers 7, lid 5*a*, holes 6 of many varying shapes and numbers, and many kinds of light emitting devices in addition to incandescent bulbs, compact fluorescent bulbs, LEDs, etc.

CONCLUSIONS, RAMIFICATIONS AND SCOPE

A number of changes are possible to the methods, parts, uses described above while still remaining within the scope and spirit of the invention. The specifics about the form and use of the invention described in this application (including the specifics in the Background, Field, Related Art, Summary, Purposes and Advantages, Abstract, Preferred Embodiment, Additional Embodiments, Descriptions of the Drawings, etc.) are examples and are not intended to be limiting in scope. Those skilled in the art will recognize certain variations, modifications, permutations, additions, subtractions and sub-combinations thereof, and may discover new fields of use. The scope of the invention is to be determined by the claims and their legal equivalents, not the examples, purposes, summary, preferred embodiments, additional embodiments, operation, parameters, or limitations etc. given above. It is intended that the claims are interpreted to include all such variations, modifications, additions, subtractions, permutations and sub-combinations as are within their true spirit and scope, including those which may be recognized later by those skilled in the art.

Aspects, as described above, may be implemented in many different forms of hardware in the implementations illustrated in the figures. The actual hardware used to implement these aspects is not limiting of the description provided herein. Thus, the operation and behavior of the aspects were described without reference to the specific hardware—it being understood that hardware can be designed to implement the aspects based on the description herein.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Also, as used herein, the article "a" is intended to include one or more items. Where only one item is intended, the term "one" or similar language is used.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described herein.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps.

To aid the Patent Office and any readers of any patent issued on this application in interpreting the claims appended hereto, applicant wishes to note that she does not intend any of the appended claims or claim elements to invoke 35 U.S.C. 112(f) unless the words "means for" or "step for" are explicitly used in the particular claim.

I claim:

1. An indirect uplight arrangement for a ceiling fan having a fan support pole comprising:

(a) a substantially circular and flat disk-shaped uplight housing attached to, or comprising an integral part of, a ceiling fan and situated above the fan, (b) a substantially circular and flat lid of the uplight housing on the top of the housing, (c) one or more light emitting holes in said substantially circular and flat lid, and (d) one or more light bulbs inside said housing substantially positioned under said light emitting holes.

2. The arrangement of claim 1, further comprising a lightbulb support inside said housing attached to said bulbs, and further comprising wiring attached to said bulbs.

3. The arrangement of claim 2, further comprising a hole for a fan support pole substantially in the center of said lid.

4. The arrangement of claim 1, further comprising one or more uplight diffusers positioned in said one or more light emitting holes.

5. An indirect uplight arrangement for a ceiling fan with a fan support pole comprising:

(a) a substantially circular and flat disk-shaped uplight housing attached to, or comprising an integral part of, a ceiling fan and situated above the fan, (b) a translucent or transparent substantially circular and flat lid of the uplight housing on the top of the housing, and (c) one or more light bulbs inside said housing.

6. The arrangement of claim 5 further comprising a lightbulb support inside said housing attached to said bulbs, and further comprising wiring attached to said bulbs.

7. The arrangement of claim 6 further comprising a hole for a fan support pole substantially in the center of said lid.

8. The arrangement of claim 1 wherein the light bulbs are selected from a group comprising traditional incandescent bulbs, compact fluorescent bulbs, bulbs containing light emitting diodes (LEDs), or any substantially compact electric light source.

9. The arrangement of claim 2 wherein the light bulbs are selected from a group comprising traditional incandescent bulbs, compact fluorescent bulbs, bulbs containing light emitting diodes (LEDs), or any substantially compact electric light source.

10. The arrangement of claim 3 wherein the light bulbs are selected from a group comprising traditional incandescent bulbs, compact fluorescent bulbs, bulbs containing light emitting diodes (LEDs), or any substantially compact electric light source.

11. The arrangement of claim 4 wherein the light bulbs are selected from a group comprising traditional incandescent bulbs, compact fluorescent bulbs, bulbs containing light emitting diodes (LEDs), or any substantially compact electric light source.

12. The arrangement of claim 5 wherein the light bulbs are selected from a group comprising traditional incandescent bulbs, compact fluorescent bulbs, bulbs containing light emitting diodes (LEDs), or any substantially compact electric light source.

13. The arrangement of claim 6 wherein the light bulbs are selected from a group comprising traditional incandescent bulbs, compact fluorescent bulbs, bulbs containing light emitting diodes (LEDs), or any substantially compact electric light source.

14. The arrangement of claim 7 wherein the light bulbs are selected from a group comprising traditional incandescent bulbs, compact fluorescent bulbs, bulbs containing light emitting diodes (LEDs), or any substantially compact electric light source.

* * * * *